United States Patent [19]

Cunningham

[11] 4,181,846

[45] Jan. 1, 1980

[54] ROTARY HEATING APPARATUS

[76] Inventor: Ronald J. Cunningham, 320 Patrician Way, Pasadena, Calif. 91105

[21] Appl. No.: 839,334

[22] Filed: Oct. 5, 1977

[51] Int. Cl.[2] ..... H05B 5/08

[52] U.S. Cl. ..... 219/10.49 A; 34/133; 74/434; 219/10.57; 219/10.79; 219/10.67

[58] Field of Search ..... 219/10.49 A, 10.49 R, 219/10.61, 10.51, 10.57, 10.73, 10.41, 10.79, 10.67, 10.69, 469, 470, 471; 34/133; 432/103, 105; 74/191, 434; 366/24, 28, 144, 146, 233

[56] References Cited

U.S. PATENT DOCUMENTS

| | | | |
|---|---|---|---|
| 1,875,516 | 9/1932 | Stary | 366/24 |
| 1,940,492 | 12/1933 | Gale | 366/233 |
| 2,122,551 | 7/1938 | Allingham | 366/233 |
| 2,566,274 | 8/1951 | White et al. | 219/10.49 |
| 2,951,139 | 8/1960 | Washburn | 219/10.49 |
| 3,363,888 | 1/1968 | Nielsen | 432/105 |
| 3,525,842 | 8/1970 | Steinhoff et al. | 219/10.57 |
| 3,872,275 | 3/1975 | Rudd | 219/10.73 |
| 4,039,794 | 8/1977 | Kasper | 219/10.49 |

*Primary Examiner*—Bruce A. Reynolds
*Assistant Examiner*—Clifford C. Shaw
*Attorney, Agent, or Firm*—Edward D. O'Brian

[57] ABSTRACT

A rotary heating apparatus utilizing induction heating can be constructed so as to utilize a rotary drum at least the periphery of which is formed of material capable of being heated by magnetic induction. An induction heating coil is located sufficiently close to at least part of the periphery of the drum so as to cause heating of at least part of the periphery of the drum as the apparatus is operated. The drum is rotatably mounted and a motor is provided for rotating the drum. During the operation of the apparatus heat will be distributed within the interior of the drum as a result of radiation and conduction from the drum and also as the result of the movement of the contents including air and any other material present within the interior of the drum as a result of rotation of the drum.

11 Claims, 6 Drawing Figures

ROTARY HEATING APPARATUS

BACKGROUND OF THE INVENTION

The invention set forth in this specification pertains to new and improved rotary heating apparatus. It is to be understood that the principles of the invention can be applied in a wide variety of differently appearing and differently constructed types of rotary heating equipment used for a variety of different diverse purposes.

A large number of different types of rotary heaters and/or rotary heating apparatuses have, of course, been known and utilized in many types of applications. Some of these have been constructed so as to utilize a heat source located within the interior of a rotary drum or similar structure. Equipment of this type is disadvantageous for some uses because the material being heated within the rotary drum may come in direct contact with the heat source used. The possibility of such direct contact with the heat source can be minimized by placing the heat source on the exterior of the rotary drum so that the drum itself acts as a transfer medium to transfer heat to the contents of the drum. Prior structures of this type are considered to be unnecessarily complex and relatively inefficient.

It is also known and quite common to utilize a heat source externally located with respect to the rotary drum and to utilize such a heat source to supply a stream of heated gas to the interior of the drum so as to heat the contents of the drum. In certain types of industrial applications heating equipment constructed so as to utilize this mode of operation is built so that the heated gas stream is fed into the drum at one end of the drum and is removed from the drum at the other end of the drum. It is also known to utilize a perforate drum which allows heated gas to pass through the perforations of the drum.

It has often been recognized that it would be advantageous to utilize induction heating as a heat source in connection with various types of rotary heating apparatus such as the types described in a generalized manner in the preceding discussion. It is considered that the reasons for this are relatively unimportant to an understanding of the present invention. Although proposals relative to the induction heating of a rotary drum in connection with a rotary heating apparatus are believed to have probably been advanced it is not considered that any successful induction heated rotary heating apparatus has been commercially utilized. The term "successful" as used in the preceding is intended to encompass the consideration of economic practicality and/or feasibility.

This latter is best explained in conjunction with one aspect of induction heating. In induction heating a coil known as an induction heating coil is supplied with electric power in a known, conventional manner. Such a coil creates a varying magnetic field which in turn causes heating within an appropriate material such as iron located adjacent to the coil. The effectiveness of the operation of the coil in causing heating is related to the distance between the coil and the object being heated. For effective heating the material being heated must be located in quite close proximity to the coil. If there is any significant distance between the coil and such an object the coil will be ineffective to cause heating in accordance with an inverse square relationship.

During the use of a rotary heating apparatus the drum forming a part of such an apparatus will normally tend to expand as a result of being heated. The amount of such expansion will, of course, vary depending upon a number of factors which are unimportant to a consideration of the present invention. If an effort were made to couple an induction heating coil directly to such a drum by locating the coil adjacent to one side of the drum the coil would have to be located sufficiently far from the drum so that the drum would not expand so as to physically engage the coil. As a result of this deliberate spacing of a coil prior to expansion of the drum there would be a loss of efficiency as the coil is started up so as to cause heating of the drum.

In some cases to avoid physical contact the coil might have to be located sufficiently far from the drum so as to be in effect incapable of causing any significant heating. While one manner of avoiding this might be to supply power to a coil located directly upon a drum through slip rings it is considered that this would be disadvantageous because of the mechanical and electrical complications. It is, of course, possible to use a coil to heat an element which in turn is used to heat a gas stream flowing into a rotary heater. This is considered to be disadvantageous and undesirable because of the complexity of the equipment required and because in effect, such a procedure involves an extra transfer of heat—a transfer from the heated element to the air or gas and then a transfer from the heated air or gas to the interior of the drum and material within it.

SUMMARY OF THE INVENTION

An object of the present invention is to provide new and improved rotary heating apparatus. More specifically the invention is intended to provide induction heating type apparatus which are advantageous as compared to types of rotary induction heating apparatus as indicated in the preceding discussion. Further objects of the present invention are to provide rotary induction heating apparatuses which are comparatively efficient from an induction heating standpoint, which are constructed so as to accommodate heat caused drum expansion or contraction without significant change in induction heating efficiency, which may be easily and conveniently constructed at a comparatively nominal cost, and which are capable of long, continuous use with minimal repairs and/or maintenance.

In accordance with this invention these and various related objectives of the invention as will be apparent from the remainder of this description are accomplished by providing a rotary heating apparatus which comprises: a rotary drum having an interior which is adapted to contain material to be heated, at least the periphery of the drum extending completely around the exterior of the drum being formed by material being capable of being heated by magnetic induction, support means for rotatably supporting said drum so that it may be rotated about its axis, induction heating coil means located sufficiently close to at least part of the periphery of said drum so as to heat at least said part of the periphery of said drum during the operation of said apparatus, and drive means for rotating the drum so that as said heating coil is operated so as to heat at least said parts of the periphery of said drum the heat produced in said part of the periphery of said drum will be distributed within the interior of the drum as a result of radiation and conduction from said drum and as a result of movement of the contents within the interior of said drum, which movement is caused by rotation of said drum.

BRIEF DESCRIPTION OF THE DRAWING

The invention is best more fully described with reference to the remainder of this specification and the appended drawing in which.

Figure 1:
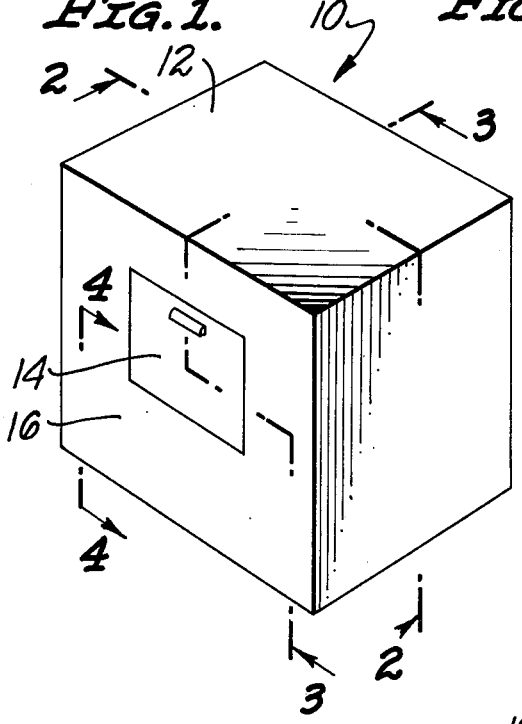
FIG. 1 is a perspective view of a presently preferred embodiment of a rotary heating apparatus in accordance with this invention.
Figure 3:
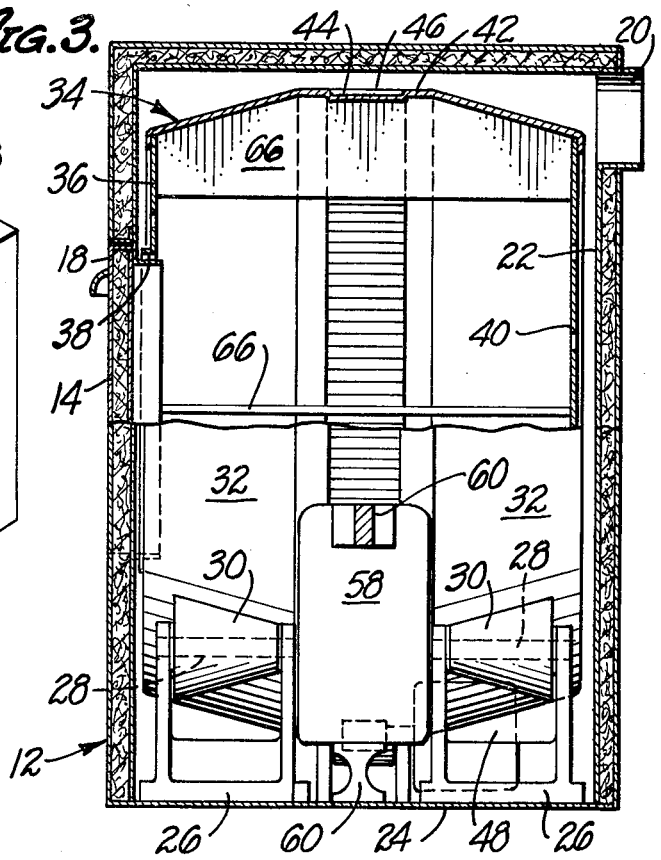
FIG. 3 is a cross-sectional view taken at line 3—3 of FIG. 1.
Figure 2:
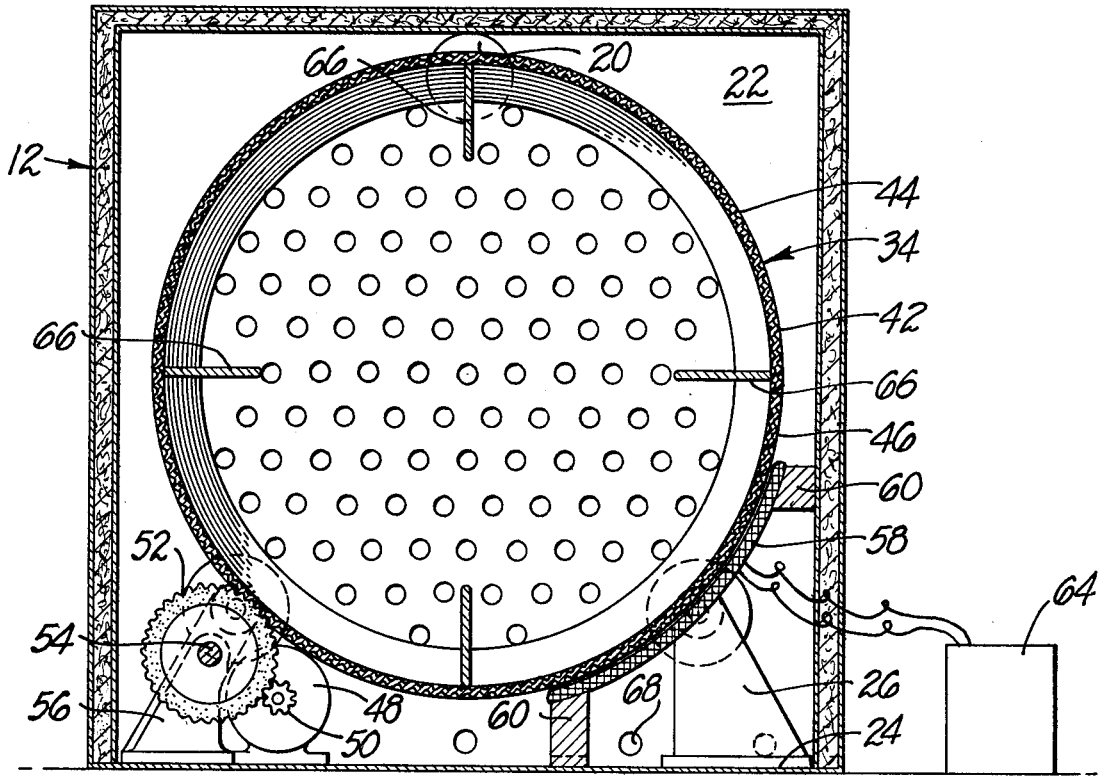
FIG. 2 is a cross-sectional view taken at line 2—2 of FIG. 1.
Figure 4:
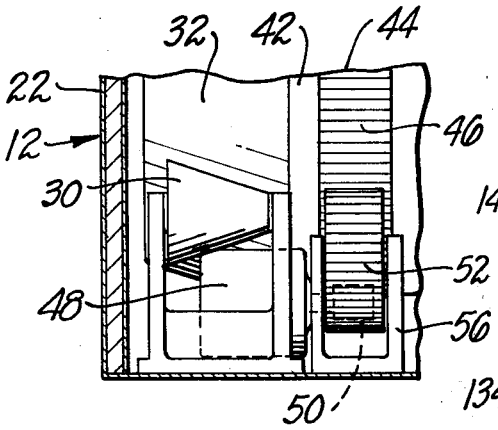
FIG. 4 is a partial cross-sectional view taken at line 4—4 of FIG. 1.

The rotary heating apparatus illustrated in the drawing are considered to embody or utilize the operative concepts or principles of the invention as set forth in the appended claims. These same concepts or principles can be utilized in a number of differently constructed and differently appearing types of rotary heating apparatuses through the use or exercise of routine engineering skill in the field of rotary dryers or heaters.

DETAILED DESCRIPTION

In FIGS. 1 to 4 of the drawing there is shown a rotary heating apparatus 10 in accordance with this invention which utilizes a conventional, rectilinear box-like cabinet 12 which, if desired, may be insulated so as to minimize heat loss. A conventional door 14 is located in the front side 16 of the cabinet 12 for the purpose of gaining access to the cabinet 12. A conventional latch 18 is provided on the door 14 for the obvious purpose. Preferably a vent-opening 20 is provided on the back side 22 of the cabinet 12 for use in conveying heated gas from the interior of the cabinet 12. On many occasions it will be necessary or advisable to connect a conventional exhaust fan (not shown) to a conventional vent conduit (not shown) for the purpose of removing heated air from the interior of the cabinet 12.

The bottom 24 of the cabinet 12 is used to support four identically formed yokes 26. Each of these yokes 26 carries an axle 28 which in turn carries a conical roller 30. These conical rollers 30 are adapted to fit against beveled surfaces 32 on a generally cylindrical drum 34 in such a manner as to rotatably support this drum 34 in such a manner that it can rotate about its axis within the interior of the cabinet 12. The drum 34 is provided with a front wall 36 having a centrally located opening 38 located adjacent to and spaced from the door 14. This drum 34 is also provided a continuous back wall 40. It includes a cylindrical peripheral wall 42 extending between the two beveled surfaces 32. Preferably this peripheral wall 42 is provided with an internally extending band-like "deformed" ring 44 including a plurality of gear teeth resembling ridges 46 extending parallel to the axis of the drum 34.

The bottom 24 is used to support or carry a small electric motor 48 used to drive a small gear 50 which mates with another gear 52. This gear 52 is mounted on a shaft 54 supported by another yoke 56 so as to be in engagement with the ring 44 in such a manner that the entire drum 34 is rotated as the motor 48 is operated. Because of heat caused expansion and contraction the gear 52 is preferably of such a character as to fit with respect to the ridges 46 in the manner of a "sloppy" gear. It is considered that the gear 52 may conveniently be formed out of a high temperature resistant material such as a silicone rubber or similar elastomeric material in order to act more or less as a friction drive as well as to act substantially as a gear. It is noted that the gear 52 is mounted so as to contact the ring 44 in alignment with the lines of contact between two of the rollers 30 and the beveled surfaces 32. This is considered desirable in accommodating heat caused temperature expansion and contraction of the drum 34.

A comparatively flat more-or-less pancake shaped slightly curved coil 58 is mounted on brackets 60 formed of a material which will not be heated during the operation of this coil 58. These brackets 60 are attached to the drum 34 so as to extend upwardly therefrom. The coil 58 is connected by means of wires 62 to an appropriate known electronic "package" 64 which is adapted to supply power to the coil 58 in order to accomplish induction heating. This "package" 64 is shown as being located remote from the cabinet 12 so as to avoid the possibility of the heat generated during the use of the dryer 10 affecting its operation.

The shape of and the position of the coil 58 are considered to be important with respect to the invention. This coil 58 is not completely flat but is curved so as to conform very closely to the exterior curvature of the peripheral wall 42 when the peripheral wall 42 is heated to the maximum extent intended in accordance with the design of the apparatus 10. The construction described is such that temperature caused expansion and contraction of the drum 34 will interfere with the magnetic coupling of the coil 58 with the peripheral wall 42 to only a very limited or minor extent. In this connection it is noted that the coil 58 is mounted between the rollers 30 adjacent to these rollers 30 so as to be symmetrical relative to an imaginary plane passing through the axis of the drum 34 and through the common axes of the rollers 30.

It will be realized for the apparatus 10 to operate in the manner described that at least the peripheral wall 42 must be formed of a material such as iron which can be heated by induction heating. It is considered preferable to form the entire drum 34 of such a material. In order to provide for effective heat transfer within the interior of the drum 34 it is considered desirable to provide within it conventional lifters 66.

Further, when it is necessary or desirable to provide for the removal of gas or air from the drum 34 it is considered advisable to form all of the parts of the drum 34 except the peripheral wall 42 of a perforate character. The peripheral wall 42 is preferably not perforated because any such perforations would tend to reduce the amount of material magnetically coupled to the coil 58 during the operation of the apparatus 10. When provision is made for air movement within the apparatus 10 if the cabinet 12 is of a reasonably air-tight character perforations 68 should be provided within the cabinet 12 remote from the vent opening 20.

It is believed that the manner in which the apparatus 10 operates will be essentially self-obvious from the preceding. As the motor 48 is operated the drum 34 will be rotated. As power is supplied to the coil 58 this coil 58 will continuously cause heating in the portion of the peripheral wall 42 directly opposite and adjacent to the coil 58. As the drum 34 is rotated such heat will be dissipated by radiation and conduction from the drum 34. This will in turn cause heating of the contents (not shown) within the interior of the drum 34. When the drum 34 is empty except for the ambient air only such air will be heated and the movement of the drum 34 will cause the air to be substantially uniformly heated throughout the interior of the drum 34. When materials or objects to be heated are located within the drum 34 such items will be heated by radiation from the drum 34 and by conduction from the drum 34 as they are in contact with the drum 34. The motion of such items as the drum 34 is operated will cause further heat transfer so as to accomplish effective heating.

During the operation of the apparatus 10 in this manner the drum 34 will tend to expand in diameter and in width or length to a limited degree. As a consequence of the structure described such expansion will be accommodated and will not interfere with the manner in which the drum 34 is supported and rotated. Neither will such expansion cause any significant variation in the effectiveness of the operation of the coil 58 in causing heat development within the drum 34.

Figure 6:
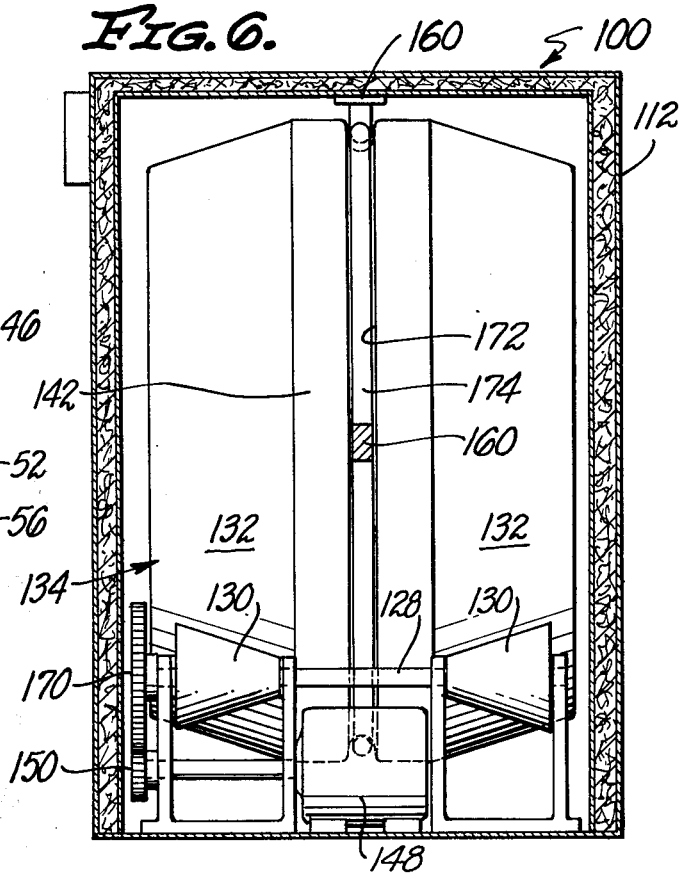
FIG. 6 is a cross-sectional view taken at line 6—6 of FIG. 5.
Figure 5:
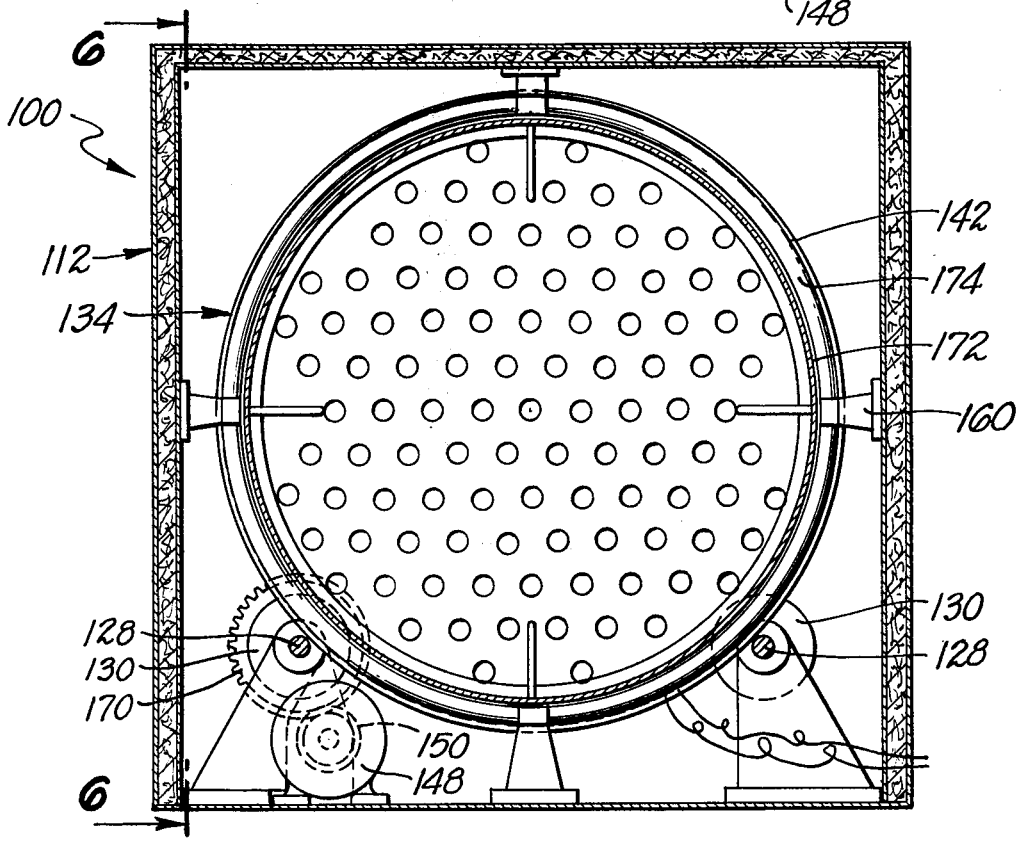
FIG. 5 is a cross-sectional view of a modified rotary heating apparatus in accordance with this invention corresponding to the FIG. 2 described in the preceding.

In FIGS. 5 and 6 of the drawing there is shown a modified heating apparatus 100 which in many respects is quite closely related to the apparatus 10. In the interest of brevity those parts of the apparatus 100 which reasonably correspond to parts in the apparatus 10 are not separately described herein and are indicated both in the drawing and in the remainder of the specification by the numerals previously used to indicate such parts preceded by the numeral 1. Thus, in the apparatus 100, the cabinet corresponding to the previously described cabinet 12 is designated by the number 112.

In the apparatus 100 two axles 128 corresponding to the previously described axles 28 are utilized. Each of the axles 128 connects two of the rollers 130. One of these axles 128 carries a gear 170 which is coupled to a motor 148 through a gear 150 for the purpose of rotating the drum 134. This drum 134 utilizes instead of the ring 44 a comparatively small groove 172 which extends completely around the peripheral wall 142. A cylindrical, ring-like coil 174 is supported within this groove 172 by means of brackets 160. This coil 174 is of such dimension as to fit closely within the interior of the groove 172 in such a manner that it will not rub against the interior of the groove 172 regardless of whether or not the drum 134 is cold or is heated to the maximum extent permitted by the design of the apparatus 100.

By virtue of the fact that the coil 174 is located in this manner within the interior of the groove 172, there is effective coupling between the coil 174 and the peripheral wall 142 which is not substantially affected by changes in dimension of the drum 134 as the apparatus 100 is operated. It is noted that the coil 174 is located so as to be slightly eccentric to the axis of the drum 134 when this drum 134 is cold. This is to accommodate expansion of the drum 134 to a position in which the center of the coil 174 is coincident with the axis of the drum 134 as the drum 134 expands to the maximum extent permitted by the design of the apparatus 100. This is not considered to significantly affect the efficiency of the heating action obtained.

I claim:

1. A rotary heating apparatus which comprises:

a rotary drum having an interior which is adapted to contain material to be heated, at last the periphery of said drum extending completely around the exterior of said drum being formed of a material capable of being heated by magnetic induction, said drum having a front wall provided with an opening therein, at least a part of said drum being perforate, said drum including lifter means located within the interior of said drum, support means for rotatably supporting said drum so that said drum may be rotated about its axis, induction heating coil means located sufficiently close to at least part of the periphery of said drum so as to heat at least said part of the periphery of said drum during the operation of said apparatus, drive means for rotating said drum so that as said heating coil is operated so as to heat at least said part of the periphery of said drum the heat provided in said part of the periphery of said drum will be distributed within the interior of said drum as the result of radiation and conduction from said drum and as the result of movement of the contents within the interior of said drum which movement is caused by rotation of said drum, and a substantially air-tight cabinet located around said drum, said support means, said heating coil means, and said drive means, said cabinet having a door located adjacent to said opening in said front wall of said drum, said cabinet having a vent opening for use in conveying heated gas from the interior of said cabinet and having means for introducing air into said cabinet remote from said vent opening.

2. A heating apparatus as claimed in claim 1 wherein:

said coil means comprises a pancake shaped coil curved so as to conform to the exterior curvature of the periphery of said drum when said drum is heated, said coil means extending part of the way around said periphery of said drum.

3. A heating apparatus as claimed in claim 1 wherein:

said support means includes a plurality of roller means serving to support said drum so that as said drum is heated it is free to expand in a direction generally away from said roller means, said coil means is located between two of said roller means which are aligned with one another.

4. A heating apparatus as claimed in claim 3 wherein:

said coil means comprises a pancake shaped coil curved so as to conform to the exterior curvature of the periphery of said drum when said drum is heated, said coil means extending part of the way around said periphery of said drum.

5. A heating apparatus as claimed in claim 1 wherein:

said drum has a front and a back and includes two beveled surfaces extending completely around said drum, said beveled surfaces being separated from one another by said peripheral wall, said peripheral wall includes a ring extending completely around said peripheral wall and extending externally of said drum from the remainder of said peripheral wall, said drive means includes means for engaging said ring so as to impart rotation to said drum, said support means includes two pairs of conical rollers, the rollers in each of said pairs being aligned with one another.

6. A heating apparatus as claimed in claim 5 wherein:

said ring includes a plurality of gear-teeth resembling ridges extending parallel to the axis of said drum, said ridges being located adjacent to one another completely around the exterior of said drum, said means for engaging said ring comprises gear means capable of engaging said ridges.

7. A heating apparatus as claimed in claim 1 wherein:

said coil means is disposed with respect to said drum so as to extend completely around said periphery of said drum.

8. A rotary heating apparatus which comprises:

a rotary drum having an interior which is adapted to contain material to be heated, at least the periphery of said drum extending completely around the exterior of said drum being formed of a material capable of being heated by magnetic induction, said drum has a front and a back and includes two beveled surfaces extending completely around said drum, said beveled surfaces being separated from one another by said peripheral wall, said peripheral wall includes a ring extending completely around said peripheral wall and extending externally of said drum from the remainder of said peripheral wall, said ring includes a plurality of gear-teeth resembling ridges extending parallel to the axis of said drum, said ridges being located adjacent to one another completely around the exterior of said drum, support means for rotatably supporting said drum so that said drum may be rotated about its axis, said support means includes two pairs of conical rollers, the rollers in each of said pairs being aligned with one another, said rollers engaging said beveled surfaces so as to support said drum, induction heating coil means located sufficiently close to at least part of the periphery of said drum so as to heat at least said part of the periphery of said drum during the operation of said apparatus, drive means for rotating said drum so that as said heating coil is operated so as to heat at least said part of the periphery of said drum the heat provided in said part of the periphery of said drum will be distributed within the interior of said drum as the result of radiation and conduction from said drum and as the result of movement of the contents within the interior of said drum which movement is caused by rotation of said drum, said drive means includes gear means capable of engaging said ridges so as to impart rotation to said drum.

9. A rotary heating apparatus which comprises:

a rotary drum having an interior which is adapted to contain material to be heated, at least the periphery of said drum extending completely around the exterior of said drum being formed of a material capable of being heated by magnetic induction, support means for rotatably supporting said drum so that said drum may be rotated about its axis, said support means includes a plurality of roller means serving to support said drum so that as said drum is heated it is free to expand in a direction generally away from said roller means, induction heating coil means located sufficiently close to at least part of the periphery of said drum so as to heat at least said part of the periphery of said drum during the operation of said apparatus, said coil means being located between two of said roller means which are aligned with one another, said coil means comprising a pancake shaped coil curved so as to conform to the exterior curvature of the periphery of said drum when said drum is heated, said coil means extending part of the way around said periphery of said drum, said drum has a front and a back and includes two beveled surfaces extending completely around said drum, said beveled surfaces being separated from one another by said peripheral wall, said peripheral wall includes a ring extending completely around said peripheral wall and extending externally of said drum from the remainder of said peripheral wall, drive means for rotating said drum so that as said heating coil is operated so as to heat at least said part of the periphery of said drum the heat provided in said part of the periphery of said drum will be distributed within the interior of said drum as the result of radiation and conduction from said drum and as the result of movement of the contents within the interior of said drum which movement is caused by rotation of said drum, said drive means including means for engaging said ring so as to impart rotation to said drum, said support means including two pairs of conical rollers, the rollers in each of said pairs being aligned with one another, said ring includes a plurality of gear-teeth resembling ridges extending parallel to the axis of said drum, said ridges being located adjacent to one another completely around the exterior of said drum, said means for engaging said ring comprises gear means capable of engaging said ridges, said gear means is formed out of an elastomeric material so as to be capable of serving as a friction drive as well as a gear.

10. A rotary heating apparatus which comprises:

a rotary drum having an interior which is adapted to contain material to be heated, at least the periphery of said drum extending completely around the exterior of said drum being formed of a material capable of being heated by magnetic induction, support means for rotatably supporting said drum so that said drum may be rotated about its axis, induction heating coil means located sufficiently close to at least part of the periphery of said drum so as to heat at least said part of the periphery of said drum during the operation of said apparatus, a groove located in said peripheral wall of said drum so as to extend completely around said peripheral wall of said drum in a plane perpendicular to the axis of said drum, said coil means comprising a ring-like coil and fits closely within said groove so as to extend completely around said periphery of said drum and so as to magnetically couple with the material comprising the periphery of said drum defining said groove, drive means for rotating said drum so that as said heating coil is operated so as to heat at least said part of the periphery of said drum the heat provided in said part of the periphery of said drum will be distributed within the interior of said drum as the result of radiation and conduction from said drum and as the result of movement of the contents within the interior of said drum which movement is caused by rotation of said drum.

11. A heating apparatus as claimed in claim 10 wherein:

said coil is located eccentric to the axis of said drum when said drum is cold and so as to be concentric with the axis of said drum when said drum is expanded through the operation of said heating apparatus.

* * * * *